United States Patent [19]

Baldenko et al.

[11] Patent Number: 4,711,006

[45] Date of Patent: Dec. 8, 1987

[54] DOWNHOLE SECTIONAL SCREW MOTOR, MOUNTING FIXTURE THEREOF AND METHOD OF ORIENTED ASSEMBLY OF WORKING MEMBERS OF THE SCREW MOTOR USING THE MOUNTING FIXTURE

[75] Inventors: Dmitry F. Baldenko, Moscow; Nikolai P. Bezlepkin, Oktyabrsky Bashkirskoi; Jury V. Vadetsky, Moscow; Moisei T. Gusman, Moscow; Jury F. Potapov, Ljubertsy Moskovskoi; Valery I. Semenets, Moscow, all of U.S.S.R.

[73] Assignee: Vsesojuzny Nauchnoissledovatelsky Institut Burovoi Tekhniki, Moscow, U.S.S.R.

[21] Appl. No.: 848,046

[22] PCT Filed: Jun. 27, 1985

[86] PCT No.: PCT/SU85/00051

§ 371 Date: Mar. 17, 1986

§ 102(e) Date: Mar. 17, 1986

[87] PCT Pub. No.: WO86/00954

PCT Pub. Date: Feb. 13, 1986

[30] Foreign Application Priority Data

Jul. 19, 1984 [SU] U.S.S.R. ..... 3771625

[51] Int. Cl.[4] ..... B23P 15/00; B23P 19/00; B23Q 17/00

[52] U.S. Cl. ..... 29/156.4 R; 29/434; 29/464; 29/469; 29/720; 29/407; 403/333; 418/5; 418/48

[58] Field of Search ..... 29/156.4 R, 434, 435, 29/464, 469, 407, 428, 700, 720; 403/333, 334, 361; 418/5, 48

[56] References Cited

U.S. PATENT DOCUMENTS 3,982,858 9/1976 Tschirky ..... 418/48
3,999,901 12/1976 Tschirky ..... 418/48
4,585,401 4/1986 Baldenko et al. ..... 29/156.4 R

FOREIGN PATENT DOCUMENTS 286502 1/1971 U.S.S.R. .

OTHER PUBLICATIONS

"Screw Hydraulic Downhole Motors for Well Drilling", Nedra Publishers, Moscow (1981), pp. 56–57.

*Primary Examiner*—Howard N. Goldberg
*Assistant Examiner*—Ronald S. Wallace
*Attorney, Agent, or Firm*—Fleit, Jacobson, Cohn & Price

[57] ABSTRACT

A downhole motor includes a bearing unit connected to a moving section incorporating successively arranged working members—a stator and a rotor interacting with each other along profile surfaces. The like pairs of the adjacent working members are rigidly connected to each other by means of solid threaded bushings. A mounting fixture includes two mounting elements each made as two bushings interconnected by a coupling, the bushings having their profile surfaces located on the same longitudinal axis. One of the bushings is rigidly connected to the coupling, while the other bushing is mounted with the possibility of moving with respect to the longitudinal axis. A method of assembling the downhole motor is effected with the use of a pre-adjusted mounting fixture and resides in interconnecting the like working members by thread bushings ensuring the arrangement of the profile surfaces of the working members analogously to the profile surface of the single monolithic rotor and stator.

3 Claims, 9 Drawing Figures

DOWNHOLE SECTIONAL SCREW MOTOR, MOUNTING FIXTURE THEREOF AND METHOD OF ORIENTED ASSEMBLY OF WORKING MEMBERS OF THE SCREW MOTOR USING THE MOUNTING FIXTURE

FIELD OF THE INVENTION

The invention relates to drilling equipment and, more particularly, to a downhole sectional screw motor and a method of oriented assembly of working members thereof using a mounting fixture.

DESCRIPTION OF THE PRIOR ART

Downhole screw motors are being increasingly employed in the practice of drilling wells. They are easy to operate and service and have small dimensions (M. T. Gusman, D. F. Baldenko et al., "Downhole Screw Motors for Drilling Wells", Nedra Publishers, Moscow, (1981)).

The length of working members, namely, stators and rotors of screw downhole motors is limited due to technological possibilities of their manufacture. Therefore, specific values of the torque and pressure drop per unit of the length of the working members or one pitch of their screw thread are adequately great.

In the easier drilling conditions involving the flushing of a bottom hole with process water, the screw downhole motors feature high efficiency and fully satisfy the requirements of drill men. However, in most regions there are used drilling muds with a high content of a solid phase, which substantially decreases the service life of the working members and is the factor limiting the universal use of such motors. In Soviet and foreign practice, downhole screw motors are updated by way of increasing the length of the working members (the number of screw pitches) with an eye to diminishing the specific contact loads in the screw pair and, consequently, extending the service life of the working members. Research is conducted in two directions: a long-term development of the technology of manufacturing monolithic multi-pitch constructions of rotors and stators, and the elaboration of methods of sectionalizing the working members of motors.

Today there are known in the art a number of technical solutions associated with the sectionalization of the working members of screw downhole motors.

There is known a method for assembling a sectional screw downhole motor structurally made in the form of two or more sections of the working members, each section comprising a rotor and a stator (cf. U.S.S.R. Inventor's Certificate No. 286502, cl. F04 5/00, 1969).

The sections are connected in the following manner: the stators are connected by means of a threaded bushing and the rotors with the aid of an articulated joint. In the given technical solution the screw surfaces of the connected and like working members may coincide only accidentally. In case of an arbitrary assembly of the working members, when a radial displacement of the adjacent rotors about the axis of the stators is possible in an opposite direction, the operation of the motor features higher radial vibrations because the displacement of the longitudinal axes of the adjacent rotors may be increased to a double eccentricity of the axis of the rotor, relative to that of the stator in a single-section variant of the motor, which leads to the destruction of the threaded joints and possible serious failures in the well, as well as brings about an intensive wear of the contact surfaces of the screw pair due to higher dynamic loads during the motor operation.

There is known in the art a mounting fixture which serves to ensure an oriented assembly of the working members of the screw downhole motor (cf. U.S. Pat. No. 3,982,858, cl. 418–48, 1976).

The fixture comprises a mounting stator and rotor, each being sufficiently long to accommodate on its profile surface the like working members (stators or rotors) being connected to each other.

The mounting stator or rotor has a profile surface adequate to the profile surface of the working members being connected.

The method of assembling the motor resides in that it is the section of the spindle that is assembled first which comprises bearing and packing units. Then the working members of the moving sections are successively assembled, seeing to it that the profile surfaces are oriented in a desired manner. The sequence of oriented assembly is as follows. Two stators, having similar geometrical dimensions of profile surfaces, are installed on the mounting rotor until the end faces having cylindrical surfaces (external on the first stator and internal - on the second one) contact each other. After ensuring the contact of the end faces, as the stators are fitted on the mated cylindrical surfaces, gage marks are applied on each stator which provide for a mutual arrangement of the stators with the mounting rotor installed therein. Thus, the profile surface is continued from one stator to another. Thereafter, the mounting rotor is removed, the applied gage marks are checked for coincidence and both stators are welded to each other along the entire perimeter of the external surface. All the subsequent stators are connected in an analogous manner.

The rotors of the above motors, ensuring the operation of the motor as they are installed in the stators, are connected to each other inside a single mounting stator whose inner surface fully corresponds to the profile surface of the rotors being connected. Once installed, the rotors are secured axially, the mounting stator is removed freeing the joint between the rotors being connected. Both rotors are welded together along the entire perimeter of the external surface. The subsequent rotors are connected in the same manner.

The aforementioned method of oriented connection of the working members allows the assembly of a requisite amount of the pairs "stator-rotor", the profile surfaces of respective working members being a single screw thread throughout the entire length thereof. Following the installation of the assembled rotors in the assembled stators, the moving section is connected to the previously assembled spindle section.

A disadvantage of the aforelisted methods of assembling the working members of the motor is technical complexities during the oriented assembly of the working members. The availability of a simplified mounting fixture made the motor design more complex. At the same time the very process of oriented assembly has become more complicated. Besides, welding of the working members is unreliable coupling in articles operating under stressed conditions of higher loads and vibrations, because the connection of adjacent like working members inevitably involves skewness and misalignment of their longitudinal axes due to unparallel location of the end faces of the working members being sectionalized. The welding of rubber-coated stators may lead to damaging of the rubber lining.

The welded joint makes the motor construction non-detachable and in case one of the working members of the sections being connected is damaged, there arises the necessity to make a complex repair of the motor or replace the latter altogether.

Another disadvantage of the said method of assembling the working members is that it is effected without a continuous visual control of the mutual arrangement of the screw thread in the rotors and stators of the sections being connected, which eventually complicates the assembly.

SUMMARY OF THE INVENTION

It is the principal object of the present invention to provide a downhole sectional screw motor and a method of oriented assembly of its working members using a mounting fixture, whereby the welding of the working members of the downhole motor is dispensed with and its assembly is streamlined.

This object is accomplished in a downhole sectional screw motor, comprising a bearing unit connected with a moving section incorporating successively disposed working members and a stator and rotor interacting with each other along the profile screw surfaces whose start is determined by screw threads of these surfaces, the like pairs of the adjacent working members being rigidly axially connected to each other, wherein, according to the invention, the rigid coaxial connection of each like pair of the adjacent working member is made in the form of a solid threaded bushing.

The disclosed downhole sectional screw motor whose working members are assembled by means of the solid threaded bushings is more reliable in operation because the thread bushing compensates for skewness and misalignment of the axes of the connected working members inevitably occurring when joining separately produced working members.

The downhole sectional screw motor in the disclosed assembly ensures a marked increase in the service life of the working members and rules out the failure of the connection unit thereof.

Besides, this object is accomplished in the mounting fixture for oriented assembly of the working members of the downhole sectional screw motor, comprising mounting elements with profile surfaces whose start is determined by the screw threads of these surfaces which corresponds to the profile surface of the motor working member, wherein, according to the invention, the mounting elements are connected in pairs by means of a coupling and each contains a bushing with a profile surface, one of said bushings is rigidly connected to the coupling, and another is mounted with the possibility of moving relative to its own longitudinal axis. The said fixture has a disk with an arrester arranged on the coupling, and the end surfaces of the disk and the movable bushing have radial cuts equidistant from one another whose number is equal to that of starts in the profile surface of the mounting element.

The assembly of the disclosed downhole sectional screw motor whose working members are connected by the solid thread bushing is possible only with the aid of a mounting fixture enabling one to control a mutual arrangement of the screw threads in the adjacent like working members—stators and rotors.

The disclosed mounting fixture ensures a visual control of the quality of assembly because the bushings linked by a coupling are mounted in the adjacent like working members, and the mutual arrangement of the screw threads is observed by a relative position of the cuts on the end face of the movable bushing and the disk.

In the method of adjusting the mounting fixture of the invention, the profile surfaces of the bushings in the mounting element are superposed with the profile surface of the adjusting element whose length is not less than the distance between the external end faces of the bushings, and the profile surface is identical to that of the motor working member, then, moving the disk with respect to the longitudinal axis of the bushings, its radial cuts are superposed with those of the movable bushing, whereupon the disk is rigidly fixed on the coupling by an arrester.

The adjustment of the mounting fixture does not require additional devices, and the adjusting element is a conventional element of the screw pair—a rotor or stator designed for assembling the downhole sectional screw motor.

This object is also accomplished owing to the fact that in the method of oriented assembly of the working members of the downhole sectional screw motor comprising the superposition of the profile surfaces of the working members of the motor and bushings of the mounting elements in the mounting fixture, according to the invention, the like working members are connected to each other by thread bushings with a pre-fastening along the threaded, the profile surfaces of the bushings of the mounting elements of the adjusted mounting fixture are superposed respectively with the profile surfaces of the working members being connected and the threads are finally fixed in the range of angular displacement of the working members, being connected within the limits of permissible torques on the screwed threads until the radial cuts on the disk coincide with those on the movable bushing of the mounting element.

The method of assembling the downhole sectional screw motor using a pre-adjusted mounting fixture streamlines the technological process of assembly, because the application of the mounting fixture rules out additional technological operations and ensures necessary accuracy of orienting the screw threads in the adjacent like working members.

Other objects and advantages of the present invention will become more apparent from the following detailed description of the exemplary embodiments thereof, with reference to the accompanying drawings in which:

DESCRIPTION OF THE EMBODIMENTS

Figure 1:
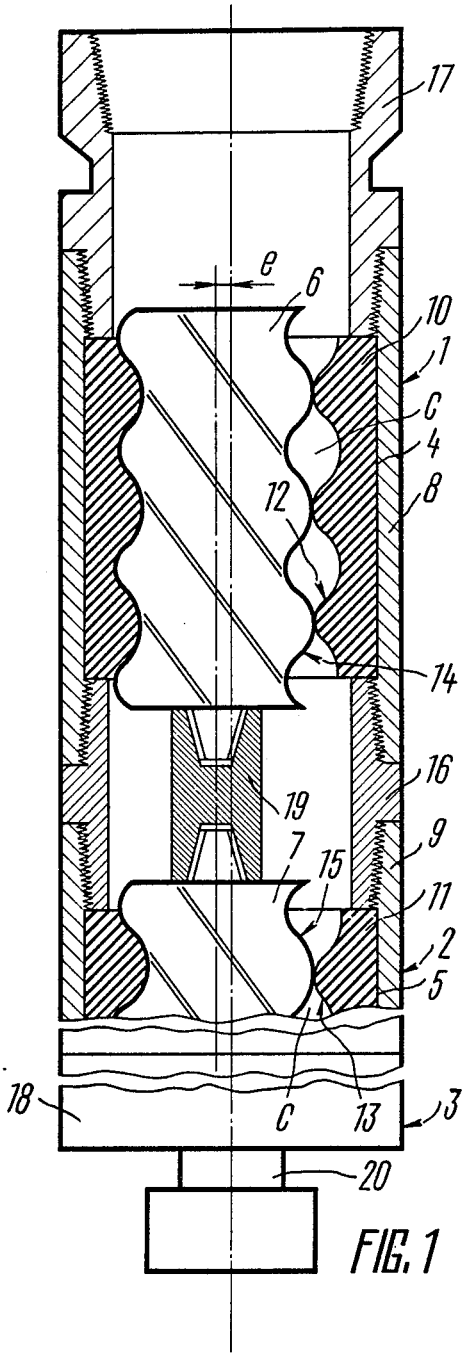
FIG. 1 is a downhole sectional screw motor, longitudinal section.

The downhole sectional screw motor, as it is represented in FIG. 1, comprises moving sections 1 and 2, as well as a spindle section 3. Each moving section 1 (2) contains working members—a stator 4 (5) and a rotor 6 (7) arranged thereinside. The stator 4 (5) is a metal body 8 (9) which an elastic lining 10 (11) is vulcanized to. The part of the elastic lining 10 (11) of the stator 4 (5) which contacts the rotor 6 (7) has a multiple-start screw profile surface 12 (13).

The rotor 6 (7) has an outer multiple-start screw profile surface 14 (15) contacting with a mated profile surface 12 (13) of the elastic lining 10 (11) of the stator 4 (5). The amount of starts of the profile surface 14 (15) of the rotor 6 (7) differs by one from the amount of starts of the profile surface 12 (13) of the elastic lining 10 (11) of the stator 4 (5).

The rotor 6 (7) is arranged inside the stator 4 (5) so that its axis is located away from the axis of the stator 4 (5) to the value of eccentricity "e".

As the profile surfaces 12 (13) of the elastic lining 10 (11) of the stator 4 (5) and rotor 6 (7) contact with each other, they form chambers C for the passage of fluid or other working agent.

The stators 4 and 5 of the moving sections 1 and 2 are connected to each other via a solid threaded bushing 16. Also secured to an upper stator 4 with the aid of a threaded is a thread bushing 17 through which the motor is connected to a drill pipe string (not shown in the FIG.) The lower stator 5 of the moving section 2 is connected to a body 18 of the spindle section 3 by means of the thread.

The rotors 6 and 7 are also connected to each other by means of a solid threaded bushing 19.

The use of solid threaded bushings 16 and 19 to connect the stators 4 and 5 and rotors 6 and 7, respectively, makes it possible to coaxially link the stators 4 and 5 and to coaxially link the rotors 6 and 7.

In its lower part the rotor 7 of the moving section 2 is connected to an output shaft 20 of the spindle section 3 which, in turn, is connected to a rock destruction tool (not shown in the FIG.)

Figure 2:
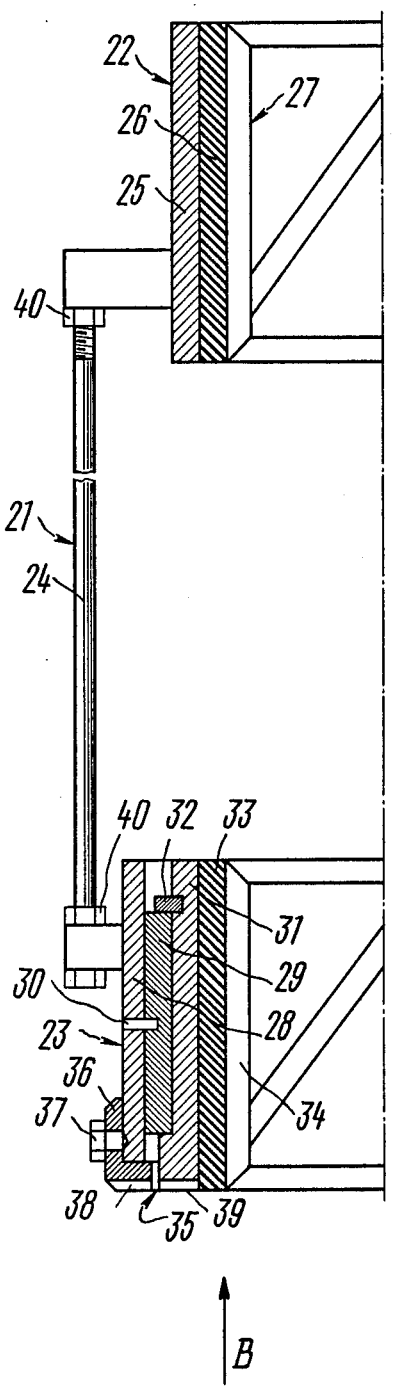
FIG. 2 is a mounting fixture for oriented assembly of rotors in the downhole sectional screw motor, longitudinal section.
Figure 3:
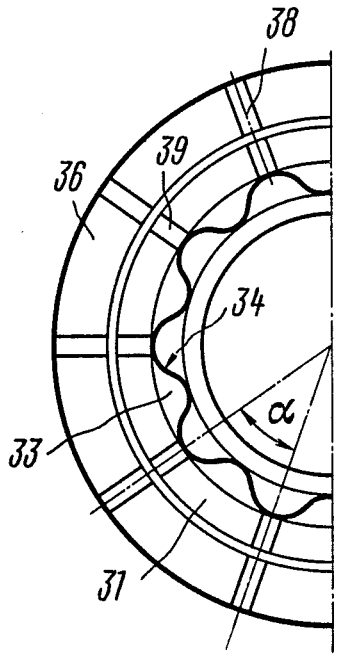
FIG. 3 is a correcting device of the mounting fixture for assembling rotors (a view taken along arrow B of FIG. 2)

A mounting fixture 21 (FIG. 2) for oriented assembly of the rotors 6 and 7 of the downhole sectional screw motor comprises two mounting elements 22 and 23 linked to each other with couplings 24. The mounting element 22 is a bushing 25 to the inner surface of which in the given variant of embodiment an elastic lining 26 having a multiple-start screw profile surface 27 vulcanized thereto. The amount of starts in the profile surface 27 is equal to the amount of starts in the profile surface 14 (15) of the rotors 6 (7), and the profile of the surface 27 is made so that as it is mated with the profile surface 14 (15) of the rotors 6 (7) so there is no clearance between them.

The mounting element 23 is made in the form of a body 28 accommodating a bearing 29 secured by a pin 30. The body 28 is rigidly connected to the bushing 25 by means of the couplings 24. Mounted in the bearing 29 is a movable bushing 31. In the given variant of an embodiment the mobility of the bushing 31 is ensured by the possibility of its rotation about its longitudinal axis. The bushings 25 and 31 are mounted coaxially.

A stop ring 32 is mounted on the outer surface of the bushing 31 to prevent the latter's axial movement.

Like the bushing 25, the movable bushing 31 has an elastic lining 33 vulcanized to its inner surface. This lining has a multiple-start screw profile surface 34. The number of starts in the surface 34 and the making of the profile are analogous to the profile surface 27 of the elastic lining 26 of the bushing 25.

The mounting fixture described herein is furnished with a correcting device 35 incorporating a disk 36 (FIG. 2,3) secured on the body 28 with the aid of a screw 37. Cuts 38 and 39 are applied on the end face of the disk 35 and the bushing 31, respectively. The distances between the cuts 38 on the surface of the disk 36 are determined by the value of central angle $\alpha$ and are the same and equal between any two adjacent cuts 38. Also equidistant from each other are cuts 39 on the end face surface of the bushing 31.

The number of the radial cuts 38 and 39 on the disk 36 and bushing 31 is equal to the number of starts on the screw profile surface 14 (15) of the rotors 6 (7).

The coupling 24 rigidly connecting the mounting elements 22 and 23 has threaded ends with nuts 40 which help regulate the distance between the mounting elements 22 and 23 in an axial direction.

Figure 4:
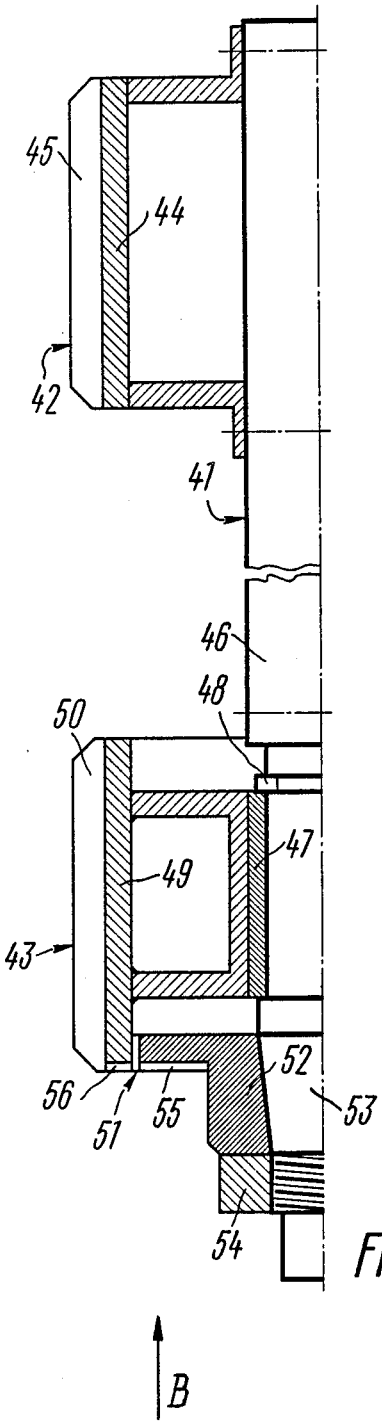
FIG. 4 is a mounting fixture for oriented assembly of stators in the downhole sectional screw motor, longitudinal section.
Figure 5:
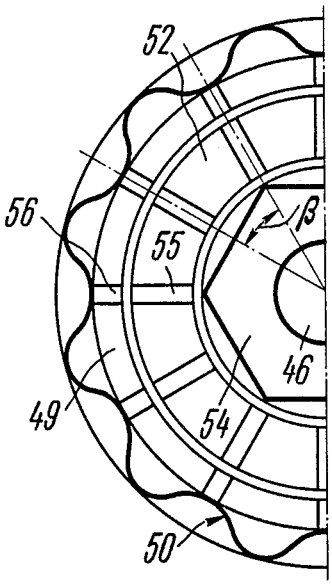
FIG. 5 is a correcting device of the mounting fixture for assembling stators (a view taken along arrow B of FIG. 4).

A mounting fixture 41 for oriented assembly of the stators 4 and 5 of the downhole sectional screw motor (FIG. 4) is made similarly.

The mounting fixture 41 described herein consists of two mounting elements 42 and 43. The mounting element 42 is a bushing 44 with a multiple-start screw profile surface 45. The bushing 44 is rigidly connected to a coupling 46 which also accommodates a mounting element 43. Arranged between the coupling 46 and the mounting element 43 is a bearing 47 which in the given variant of an embodiment of the mounting fixture 41 allows the rotation of the mounting element 43 about the longitudinal axis of the bushing 44. To preclude an axial movement of the mounting element 43 along the coupling 46, the latter accommodates a stop ring 48. The mounting element 43 is made in the form of a movable bushing 49 with a multiple-start screw profile surface 50. Bushings 44 and 49 are mounted coaxially.

Like the previous one, the mounting fixture 41 described herein is furnished with a correcting device 51 (FIG. 4,5) which comprises a disk 52 arranged on a tapered surface 53 of the coupling 46. To rigidly secure the disk 52, provision is made for a nut 54 which can axially move along the coupling 46 in the thread.

Arranged on the end face surface of the disk 52 are radial cuts 55. The distances between the cuts 55 are determined by the value of central angle $\beta$ and are the same and equal between any two adjacent cuts 55. Also equidistant from each other are cuts 56 on the end face surface of the movable bushing 49.

The number of radial cuts 55 and 56 on the disk 52 and bushing 49 is equal to the number of starts on the screw profile surface 12 (13) of the elastic lining 10 (11) of the stator 4 (5). In turn, the profiles of the surfaces 45 and 50 of the bushings 44 and 49, respectively, are made so that when they mate with the profile surface 12 (13) of the elastic lining 10 (11) of the stator 4 (5), there is no clearance therebetween.

The adjustment of the mounting fixture 21 or of mounting fixture 41 for oriented assembly of the rotors 6 and 7 (or stators 4 and 5) of the downhole sectional screw motor is performed so that a single profile surface of the mounting elements 22 and 23 (42 and 43) is preserved, while the latter are arranged on the profile surfaces 14 and 15 (12 and 13) of the connected rotors 6 and 7 (or stators 4 and 5) with the possibility of carrying out continuous visual control, i.e., the profile surface 34 (50) of the mounting element 23 (43) is the continuation of the profile surface 27 (45) of the mounting element 22 (42).

Figure 6:
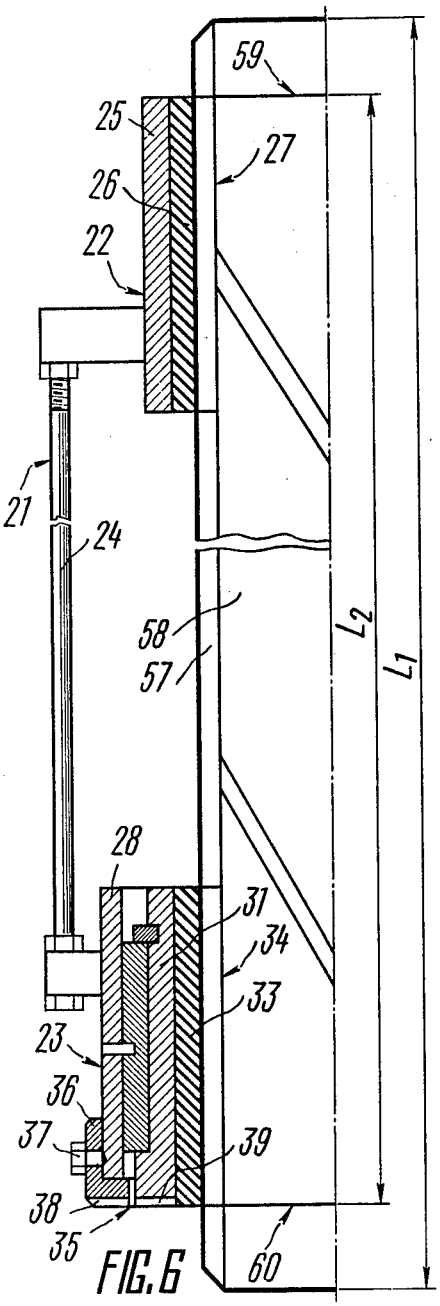
FIG. 6 is a diagram illustrating the method of adjusting the mounting fixture for oriented assembly of rotors.

A method of adjusting the mounting fixture 21 for oriented assembly of the rotors 6 and 7 resides in the following (FIG. 6): the mounting fixture 21 is arranged on the profile surface 57 of an adjusting rotor 58. Length $L_1$ of the multiple-start profile surface 57 of the rotor 58 is at least equal to distance $L_2$ between outer end faces 59 and 60 of the mounting elements 22 and 23. Since the profile surfaces 27 and 34 of the elastic linings 26 and 33 of the mounting elements 22 and 23 are adequate to the profile surface 57 of the adjusting rotor 58, once the mounting fixture is installed on the adjusting rotor 58, in this position the profile surface 34 of the lining 33 of the mounting element 23 will be the continuation of the profile surface 27 of the elastic lining 26 of the mounting element 22. At the same time, the mounting elements 22 and 23 are rigidly linked with each other by couplings 24, and the disk 36 of the correcting device 35 is in a free, unfixed position. Rotating the disk 36 about the longitudinal axis of the bushings 25, 31, the disk 36 is displaced in an angular direction so that the radial cuts 38 of the disk 36 coincide with the radial cuts 39 applied on the end face surface of the bushing 31. Since the radial cuts 38 and 39 on both parts are applied uniformly, i.e., the central angle $\alpha$ between any two adjacent radial cuts is the same, the radial cuts 38 and 39 may coincide at any position of the disk 36. After the disk 36 is installed relative to the bushing 31 so that the cuts 38 coincide with the cuts 39, without changing the position of the parts, the position of the disk 36 is fixed with respect to the body 28 with the aid of a screw 37. Because the body 28 of the mounting element 23 is rigidly connected to the bushing 25 of the mounting element 22 by means of the coupling 24, and the disk 36 is rigidly secured relative to the body 28, the mounting fixture 21 is on the profile surface 57 of the adjusting rotor 58, and the fixture 21 is considered to be adjusted upon the completion of the operations.

Figure 7:
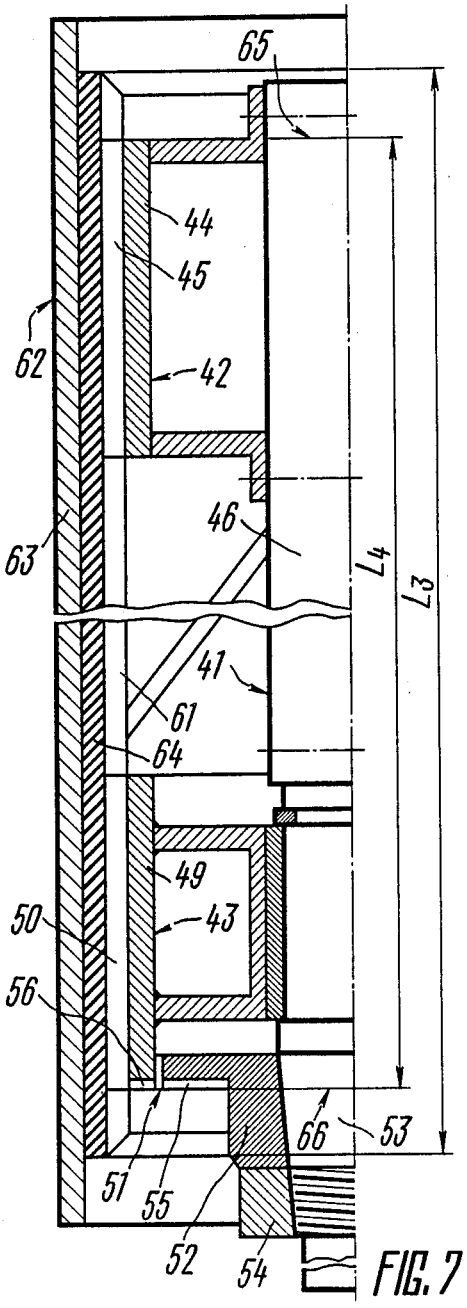
FIG. 7 is a diagram illustrating the method of adjusting the mounting fixture for oriented assembly of stators.

The mounting fixture 41 for oriented assembly of the stators 4 and 5 (FIG. 7) is adjusted in a similar manner. The adjustment technique consists in the following. The mounting fixture 41 is arranged on the profile surface 61 of the adjusting stator 62. In the given variant of an embodiment the adjusting stator 62 is made in the form of a body 63 with an elastic lining 64 vulcanized to its inner surface. Length $L_3$ of the profile surface 61 of the adjusting stator 62 is at least equal to a respective distance $L_4$ between the outer end faces 65 and 66 of the mounting elements 42 and 43. Like in the preceding case, the profile surface 61 of the elastic lining 64 of the adjusting stator 62 is adequate to the profile surfaces 45 and 50 of the mounting elements 42 and 43. Therefore, after installing the mounting fixture 41 in the adjusting stator 62 the profile surface 50 of the mounting element 43 will be the continuation of the profile surface 45 of the mounting element 42.

The bushing 44 of the mounting element 42 is rigidly secured on the coupling 46, and the position of the movable bushing 49 is conditioned by the adjusting stator 62 inside of which there is the mounting fixture 41. The disk 52 rotates about the longitudinal axis of the bushings 44, 49 in an angular direction so that the radial cuts 55 of the disk 52 coincide with the radial cuts 56 on the end face surface of the movable bushing 49. Whereupon, the disk 52 is moved axially to the tapered surface 53 of the coupling 46 with the aid of a nut 54 and said disk 52 is secured on the latter. Because once the bushing 44 of the mounting element 42 and the disk 52 of the correcting device 51 of the mounting element 43 have been arranged on the profile surface 61 of the adjusting stator 62, and the cuts 55 and 56 of the disk 52 and the movable bushing 49 have been rigidly secured on the coupling 46, the adjustment of the mounting fixture is considered to be completed.

The thus adjusted mounting fixtures 21 and 41 are further used for oriented assembly of the stators 4 and 5 and rotors 6 and 7 of the downhole sectional screw motor.

Figure 8:
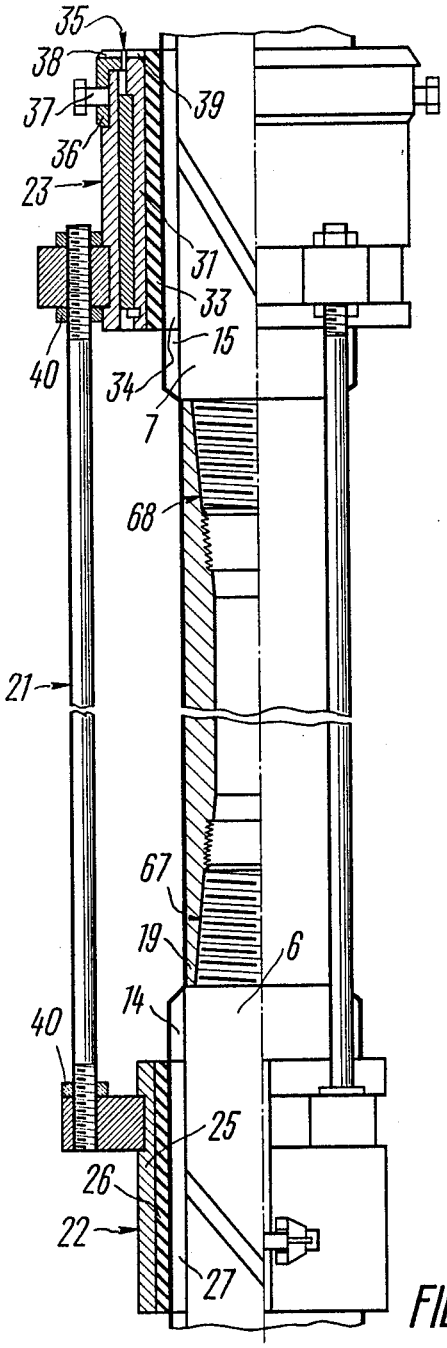
FIG. 8 is a diagram illustrating the method of oriented assembly of the rotors in the downhole sectional screw motor.

The assembly of the downhole sectional screw motor is performed by a successive assembly of the rotors 6 and 7 and the stators 4 and 5 of the moving sections 1 and 2. The rotors 6 and 7 are assembled in the following manner (FIG. 8). The rotors 6 and 7 are connected to each other by means of the threaded bushing 19, whereupon, they are pre-secured along the threads 67 and 68. Then, the mounting fixture 21 with the correcting device 35 is arranged on the profile surfaces 14 and 15 of the rotors 6 and 7 the parts being connected in such a manner that the profile surface 27 of the elastic lining 26 of the mounting element 22 is located on the profile surface 14 of the rotor 6, while the profile surface 34 of the elastic lining 33 of the movable bushing 31 of the mounting element 23 is located on the profile surface 15 of the rotor 7. Thereafter, threads 67 and 68 are finally secured. As the threads 67 and 68 are secured, the rotor 6 is fixed immovably along with the mounting element 22 of the mounting fixture 21, which is also rigidly fixed. The rotor 7 installed in the movable portion of a mechanical assembly wrench (not shown in the Fig.) rotates along with the movable bushing 31 relative to the immovable body 28 of the mounting element 23. As the threads 67 and 68 are screwed, there is attained the coincidence of the radial cuts 39 of the movable bushing 31 with the radial cuts 38 of the disk 36 of the pre-adjusted correcting device 35 in the range of angular displacement of the parts being connected (rotors 6 and 7 and thread bushing 19) within the limits of permissible torques on the screwed threads 67 and 68. During the assembly there is effected a constant visual control of the value of screwing torque and the position of the radial cuts 38 and 39.

The rotors 6 and 7 assembled in such a manner have the profile surfaces 14 and 15, one being the continuation of the other, or in other words, are a monolithic rotor with a single profile surface.

Figure 9:
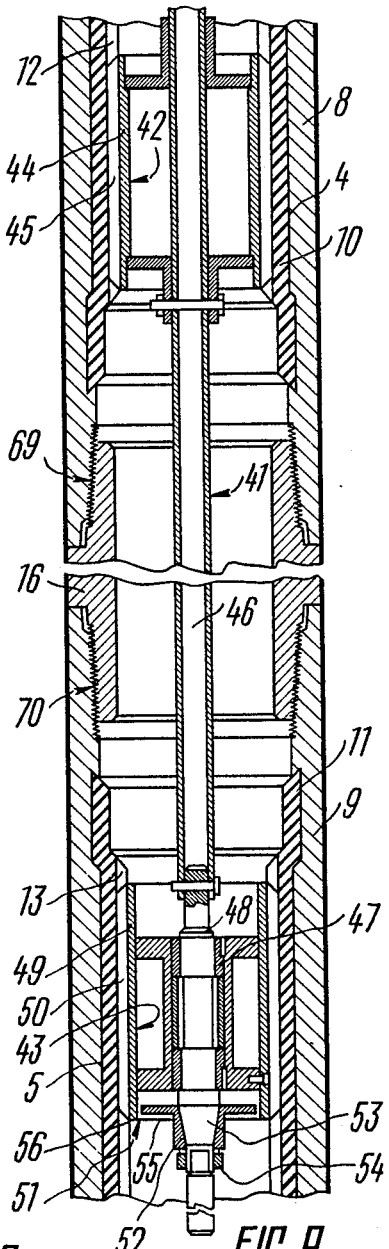
FIG. 9 is a diagram illustrating the method of oriented assembly of the stators in the downhole sectional screw motor.

The oriented assembly of the stators 4 and 5 of the downhole sectional motor is performed in a similar manner with the aid of the mounting fixture 41 with the correcting device 51 (FIG. 9). At first, the stators 4 and 5 are connected to each other by means of the threaded bushing 16 and all the connected parts are pre-secured to each other along the threads 69 and 70. Then, the mounting fixture 41 with the correcting device 51 are arranged on the profile surfaces 12 and 13 of the stators 4 and 5 so that the profile surface 45 of the bushing 44 of the mounting element 42 is on the profile surface 12 of the elastic lining 10 of the stator 4, and the profile surface 50 of the movable bushing 49 of the mounting element 43 is on the profile surface 13 of the elastic lining 11 of the stator 5. Then the threads 69 and 70 are finally secured. As the threads 69 and 70 are secured, the stator 4 is rigidly fixed alongside the mounting element 42 of the mounting fixture 41 which is also fixed, and the stator 5 with the movable bushing 49 of the mounting element 43 rotates in the movable portion of the mechanical wrench (not shown in the Fig.) with respect to the immovable disk 52 rigidly secured on the coupling 46. The coincidence of the radial cuts 56 of the movable bushing 49 with the radial cuts 55 of the disk 52 of the correcting device 51 is attained in the range of angular displacements of the parts being connected (the stators 4 and 5 and the threaded bushing 16) within the limits of permissible torques on screwed threads 69 and 70.

Like in the case of the oriented assembly of the rotors 6 and 7, the stators 4 and 5 assembled according and 13 anzaloguus to the profile surface of the single monolithic stator.

A requisite amount of the like parts (rotors and stators) can be assembled into a single monolithic group having a single profile surface. Then, the rotors 6 and 7 assembled in such a manner are installed in the stators 4 and 5 assembled analogously, the threaded bushing 17 is secured to the upper stator 4 and both moving sections 1 and 2 are connected with the spindle section 3 of the screw downhole sectional motor (FIG. 1).

INDUSTRIAL APPLICABILITY

The present invention can be most advantageously used as a hydraulic downhole motor for drilling oil and gas wells.

The invention can also be used in the mining industry, in drilling artesian, geological-exploratory wells and the overhaul of wells.

We claim:

1. A method of oriented assembly of successive working members of a downhole sectional screw motor which includes an output shaft, a moving section connected to the output shaft and incorporating successively arranged working members each working member including a stator and a rotor each having screw surfaces that interact with each other and having multiple screw starts that are equal for pairs of the surfaces, the like pairs of the adjacent working members being rigidly coaxially connected to each other, wherein the rigid coaxial connection of each like pair of the adjacent working members is made in the form of a solid threaded bushing using a frame including mounting elements each having multiple start screw profile surfaces, the number of multiple starts being equal and determined by the number of starts of screw threads on a screw profile surface of a working member of the motor, coupling means for connecting the mounting elements in spaced relationship, a bushing carried in each mounting element and having a surface defining the screw profile surface, the bushings being installed coaxially with each other, one of the bushings being rigidly connected to the coupling means and the other bushing mounted for movement with respect to its longitudinal axis, a disk including securing means, the disc carried by one mounting element of the coupling the disk and the movable bushing each having angularly equidistantly spaced radial cuts whose number is equal to the number of starts in the profile surfaces of the mounting elements, which method comprises: superposing the profile surfaces of the working members of the motor and the bushings of the mounting elements of the mounting fixture, connecting like working members to each other by threaded bushings with a pre-securing movement along the threads superposing the profile surfaces of the bushings of the mounting elements of the adjusted mounting fixture respectively with the profile surfaces of the working members being connected, and securing the threads in the range of angular displacements of the connected working member within the limits of the permissible torques on the screwed threads until radial cuts on the disk and radial cuts on the movable bushing of the mounting element are aligned.

2. A method of adjusting a mounting fixture for oriented assembly of successive working members of a downhole sectional screw motor, wherein said mounting fixture includes a frame having mounting elements each having multiple start screw profile surfaces, the number of multiple starts being equal and determined by the number of starts of screw threads on a screw profile surface of a working member of the motor, coupling means for connecting the mounting elements in spaced relationship, a bushing carried in each mounting element and having a surface defining the screw profile surface, the bushings being installed coaxially with each other, one of the bushings being rigidly connected to the coupling means and the other bushing mounted for movement with respect to its longitudinal axis, a disk including securing means, the disc carried by one mounting element of the coupling the disk and the movable bushing each having angularly equidistantly spaced radial cuts whose number is equal to the number of starts in the profile surfaces of the mounting elements, said method comprising; superposing the profile surfaces of the bushings of the mounting elements with the profile surface of an adjusting element whose length is not less than the distance between external end faces of the bushings and the profile surface of the adjusting element is identical to that of the working member of the motor, and moving a disk relative to the longitudinal axis of the bushings until radial cuts in the disc are aligned with radial cuts in the movable bushing and rigidly securing the disk on the coupling by means of an arrester.

3. A mounting fixture for oriented assembly of successive working members of a downhole sectional screw motor which includes an output shaft, a moving section connected to the output shaft and incorporating successively arranged working members each working member including a stator and a rotor each having screw surfaces that interact with each other and having multiple screw starts that are equal for pairs of the surfaces, the like pairs of the adjacent working members being rigidly coaxially connected to each other, wherein the rigid coaxial connection of each like pair of the adjacent working members is made in the form of a solid threaded bushing, said fixture comprising: mounting elements each having multiple start screw profile surfaces, the number of multiple starts being equal and determined by the number of starts of screw threads on a screw profile surface of a working member of the motor, coupling means for connecting the mounting elements in spaced relationship, a bushing carried in each mounting element and having a surface defining the screw profile surface, the bushings being installed coaxially with each other, one of the bushings being rigidly connected to the coupling means and the other bushing mounted for movement with respect to its longitudinal axis, a disk including securing means, the disc carried by one mounting element of the coupling, the disk and the movable bushing each having angularly equidistantly spaced radial cuts whose number is equal to the number of starts in the profile surfaces of the mounting elements.

* * * * *